US006783847B1

(12) United States Patent
Minami et al.

(10) Patent No.: US 6,783,847 B1
(45) Date of Patent: Aug. 31, 2004

(54) OFFSET PRINTING PAPER

(75) Inventors: Toshiaki Minami, Tokyo (JP); Toshimi Satake, Tokyo (JP); Yukiko Oohira, Tokyo (JP); Toshiyuki Takano, Tokyo (JP); Jyunichi Komai, Tokyo (JP); Mitsutoshi Nakamura, Tokyo (JP); Hideki Fujiwara, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 10/069,429

(22) PCT Filed: Jun. 5, 2000

(86) PCT No.: PCT/JP00/03618

§ 371 (c)(1),
(2), (4) Date: Jun. 10, 2002

(87) PCT Pub. No.: WO01/14638

PCT Pub. Date: Mar. 1, 2001

(30) Foreign Application Priority Data

| | | |
|---|---|---|
| Aug. 19, 1999 | (JP) | 11-233238 |
| Feb. 9, 2000 | (JP) | 2000-031337 |
| May 8, 2000 | (JP) | 2000-134485 |

(51) Int. Cl.[7] ..... D21H 19/40

(52) U.S. Cl. ..... 428/331; 428/328; 428/330; 428/337; 428/340; 428/341; 428/342; 428/452; 428/512; 428/513; 428/514; 428/537.5

(58) Field of Search ..... 428/328, 330, 428/331, 337, 340, 341, 342, 452, 512, 513, 514, 537.5

(56) References Cited

U.S. PATENT DOCUMENTS 6,420,039 B1 * 7/2002 Field et al. ..... 428/451

FOREIGN PATENT DOCUMENTS

| | | |
|---|---|---|
| JP | 03-199491 | 8/1991 |
| JP | 05-339897 | 12/1993 |
| JP | 11-131391 | 5/1999 |
| JP | 2000-160498 | 6/2000 |

* cited by examiner

*Primary Examiner*—D. S. Nakarani
(74) *Attorney, Agent, or Firm*—Knobbe, Martens Olson & Bear LLP

(57) ABSTRACT

To accommodate recent progress in printing technologies including conversion to offset printing, color printing, high-speed mass printing and automation of printing, by providing a coating layer containing an inorganic surface preparation agent mainly comprising silica sol and colloidal silica or a coating layer containing an inorganic surface preparation agent, to which an inorganic pigment, surface-sizing agent, inorganic salt and/or organic binder accordingly added in addition to silica sol or colloidal silica, offset paper serviceable for newsprint paper, which has improved qualities such as high whiteness, excellent water absorption resistance and ink acceptability, few adhesion troubles such as surface tack and curling caused by adhesion, and low chemical oxygen demand COD) load in wastewater when recycled, is provided.

20 Claims, No Drawings

OFFSET PRINTING PAPER

CROSS-REFERENCE TO RELATED APPLICATION

This is the National Phase under 35 U.S.C. §371 of International Application No. PCT/JP00/03618, filed Jun. 5, 2000, which claims priority to Japanese Patent Application Nos. 11/233238 filed Aug. 19, 1999, 2000-31337 filed Feb. 9, 2000, and 2000–134485 filed May 8, 2000.

TECHNICAL FIELD

The present invention relates to base paper for offset printing, particularly to newsprint paper for offset printing, which has a high whiteness degree, excellent water absorption resistance and ink acceptability by providing a coated layer of an inorganic surface preparation agent mainly comprising colloidal silica or silica sol, which has fewer adhesion problems such as surface tack, curling caused by adhesion and has low paper powder accumulation at offset printing and strike through after offset printing, and which contains low chemical oxygen demand (COD) load in wastewater when recycled is low.

BACKGROUND ART

In recent years, printing technologies have made great progress in conversion to offset printing, color printing, high-speed mass printing and automation of printing. With the advance of technologies, regarding printing paper as well, improvement of its various physical properties is demanded from workability and printability aspects.

Particularly, offset paper (newsprint paper, rolls of newsprint) is generally a type of paper mainly comprising mechanical pulp and deinked pulp ("DIP"). Even though the offset paper is classified into medium- or low-grade paper, it has more rigorous quality requirements for it than for general printing paper, because the specified number of copies needs to be printed without fail within the specified time in the specified time slot. Consequently, newsprint paper is special paper which can be uniquely classified in paper classification. Since lightness in weight, high DIP composition, etc. are currently demanded for newsprint paper, various improvements on newsprint paper need to be made while overcoming the minus factors. Thus, it is more difficult to improve newprint paper in comparison to general high-quality printing paper. For that reason, diverting technologies used for high-quality printing paper directly to newsprint paper is difficult. Conversely, it is relatively easy to divert technologies used for newsprint paper to general printing paper.

In newspaper printing, conversion from letterpress to offset printing is rapidly progressing along by the introduction of more computer systems in light of the demands for speeding up and automating printing, adding more color supplements and various kinds of printing, etc.

This recent diffusion of offset printing demands newsprint paper to possess qualities different from those of newsprint paper for letterpress. Quality requirements for offset newsprint paper include, for example, 1) low surface tack, i.e., good peeling property, 2) low paper powder accumulation on a blanket, 3) no web paper breaks caused by dampening solution during offset printing while maintaining adequate water-absorption resistance, 4) adequate print ink setting property, 5) high opacity and no strike-through, and 6) adequate friction coefficients. Among these quality requirements, particularly 1) lowering of surface tack, 2) improving of water absorption resistance, 3) improving of print ink acceptability, 4) high opacity and no strike-through, etc. are important issues that need to be addressed.

General printing paper possesses a low content of mechanical pulp and a high content of hardwood bleached kraft pulp (LBKP), while newsprint paper possesses a high content of mechanical pulp and DIP. Therefore, newsprint paper has more miniaturized fibers, and a problem with paper powder is more likely to occur. Additionally, when a mechanical pulp content is high, cohesion between miniaturized fibers is weak and a paper surface state is coarse. Consequently, paper powder falls off from the paper surface and tends to increase the paper powder accumulation on the blanket during the printing.

In 1989, 96% of newsprint paper had a basis weight of 46 $g/m^2$ and in 1993, 80% of newsprint paper had a basis weight of 43 $g/m^2$. Since newsprint paper is becoming lighter and lighter, problems such as lowered opacity and lowered paper strength, etc. occur. To compensate for these problems, a compounding ratio of an inorganic and an organic filler or pigment needs to be increased. However, by increasing a compounding ratio of a filler and a pigment, it facilitates the filler or the pigment to desorb, coupled with thinner and lighter paper. In the case of offset printing using a dampening solution, a tendency in desorption further increases because the dampening solution weakens cohesion between pulp fibers. These desorption tendencies become more serious problems as newsprint paper is getting lighter and lighter. For example, it becomes increasingly difficult to improve the newsprint paper of basis weight below 40 $g/m^2$ than to improve the newsprint paper of basis weight above 43 $g/m^2$.

Furthermore, a higher compounding ratio of DIP brings about an increase in DIP-derived miniaturized fibers and increased filler and pigment quantities and causes problems such as increased paper powder and lowered paper strength, coupled with a lighter weight of the paper. Additionally, DIP manufactured from magazine recycled waste paper contains tacky substances comprising a hot-melt adhesive, an acrylic adhesive and a vinyl acetate adhesive, which are used as a glue for the back of a magazine. If these tacky substances exist in a large quantity on a paper surface, the tacky substances adhere to a canvas, a belt, a roll surface, etc. and contact the paper when the paper passes through a paper manufacturing machine and/or a printing press causing such problems as web paper breaks and holes (adhesion troubles). Particularly, in the case of an offset web press type that controls paper running by bringing a steel belt into contact with a roll surface, this tendency is prominent. As a paper surface adheres to the steel belt, web paper breaks or holes (curling caused by adhesion) occur.

Improving paper surface strength was considered as a measure for addressing these newsprint paper problems. Known measures of improving the surface strength of newsprint paper are divided roughly into those by non-coating and those by coating.

Measures by non-coating include methods by changing a compounding ratio of raw materials, changing papermaking conditions, increasing a quantity of paper strength fortifier, etc. However, with these methods, it is difficult to respond to the rigorous quality requirements of newsprint paper.

Measures by coating are methods for coating (externally applying) a starch, a modified starch (oxidized starch, starch derivatives, etc.) or surface preparation agents such as polyvinyl alcohol on the surface of base paper for newsprint. These measures have become effective means for improving the surface strength.

From an economic standpoint, on-machine coating of a surface preparation agent on the newsprint paper is a commonly employed method. A gate roll coater, a method for forming and transferring a film with which high-speed coating is possible, is used. Characteristics of this gate roll coater method are summarized, for example, in Proceedings of the Japan Technical Association of the Pulp and Paper Industry Vol. 43, No. 4 (1989), p.36, the Paper Pulp Technical Times Vol. 36, No.12 (1993), p.20 among others. The method using the gate roll coater makes it possible to efficiently lay a coating solution on the paper surface and is useful for improving the paper surface as compared with the two-roll size press method used for general printing paper. More specifically, in the two-roll size press method the coating solution deeply penetrates into the base paper as the base paper passes through a pond of the coating solution whereas, in the gate roll coater method, penetration of the coating solution into the base paper is considerably controlled, because the coating solution forms a film beforehand and the film formed is transferred onto the paper surface. For this reason, a coating layer is formed evenly on the surface of the base paper with the gate roll coater method.

To control curling caused by adhesion, which is mentioned above, there are such means as removal or micro scattering of a tacky substance from raw materials, change in a compounding ratio of raw materials, change in papermaking conditions and coating of a surface preparation agent. Currently in the art, centrifugal processing and cleaner processing or mechanical scattering cannot achieve complete removal or scattering. Changing a compounding ratio of raw materials and papermaking conditions did not resolve the curling caused by adhesion.

As measures for improving the paper surface strength, a method for (externally) coating a surface preparation agent comprising a water-soluble high polymer such as a starch, a modified starch, polyvinyl alcohol, etc. has been known. To control the curling caused by adhesion by this method, it is necessary to coat a large quantity of the surface preparation agent. However, during the offset printing or newsprint paper manufacture, by using a large quantity of the surface preparation agent, the stickiness caused by the surface preparation agent increases under the influence of a dampening solution (a phenomenon called "Neppari"). Due to the Neppari, this method was entirely unserviceable.

In the case of an offset press used for full-color printing, which is making headway in newspaper printing, a problem with Neppari is even prominent because a paper surface is dampened with water four times. Additionally, poor wet ink acceptability (i.e., a phenomenon of poor acceptability of black ink after cyan-magenta-yellow color printing) can easily occur.

When coating a conventional surface preparation agent using a film transfer method such as a gate roll coater, it is difficult to improve poor ink acceptability and surface tack (Neppari) at offset printing. Additionally, when tacky substances were mixed in a paper surface from the papermaking process using the raw materials and an internal size, it was extremely difficult to prevent problems such as curling caused by adhesion.

To add to the above, eluting into wastewater during the recycling process, a surface preparation agent comprising a water-soluble high polymer increases a chemical oxygen demand ("COD") load and a biological oxygen demand ("BOD") load providing a nutrition source for microorganisms, and facilitating generation of slime. There is a possibility that slime, filler and hydrophobic constituents become a complex particle, further presenting new problems.

DISCLOSURE OF INVENTION

Aspects of the present invention provide printing paper having characteristics such as good peeling property, low paper powder accumulation on the blanket, no paper breaks caused by dampening solution during offset printing with water-absorption resistance properly maintained, adequate print ink setting property, high opacity and no strike-through, and adequate friction coefficients for the purposes of responding to current printing circumstances, i.e., increased use of offset printing, color printing, and high-speed mass printing, and automation of printing.

More specifically, the present invention can provide offset paper with sufficient surface strength and improved surface tack and curling caused by adhesion and excellent ink acceptability although the offset paper contains DIP that includes tacky substances. The present invention further can provide the offset paper with less COD load in wastewater in the recycling process.

The inventors of the present invention have found that curling caused by adhesion, ink acceptability and Neppari can be improved by coating an inorganic surface preparation agent mainly comprising silica sol or colloidal silica on base paper for printing and have solved the above-mentioned issues. Additionally, the inventors have also found that opacity can be improved simultaneously by adding an inorganic pigment in addition to silica sol or colloidal silica.

As examples of using colloidal alumina or silica sol or colloidal silica as a surface preparation agent, in the Japanese Patent Laid-open No.1992-12879 journal, a case of printing by coating water dispersions, in which a surface-active agent is added by below 5 parts by weight to 100 parts by weight of colloidal alumina on various matters to be printed including synthetic resin films, was disclosed. In the Japanese Patent Laid-open No.1992-327297 journal, an anti-slip agent, in which colloidal alumina and colloidal silica are mixed along with whisker, was disclosed. In the Japanese Patent Laid-open No.1994-48022 journal, for improving fixation of a toner for carbonless copy paper, as an inorganic colloid coating composition, colloidal alumina and silica sol are described. In the Japanese Patent Laid-open No.1998-131091 journal, newsprint paper for electro-coagulation printing on which a coating layer mainly comprising silica sol or colloidal silica, and binder is provided, is described. Furthermore, to prevent slip by increasing a friction coefficient of corrugated paperboard, use of colloidal silica is mentioned by Inoue and others (M. Inoue, N. Gurumagul, and P. Aroca, Tappi Journal, 72(12), 81–85, 1990). Similarly, C. H. Fletcher discusses that colloidal silica is used as a material for increasing friction in a report titled "Slip Prevention Processing Using Colloidal Silica" (Refer to C. H. Fletcher, Tappi Journal, 1973, 56(8), 81–85).

There is more literature regarding improved yields of a filler and microscopic fibers during the papermaking by adding colloidal silica to a paper material. However, in the above-mentioned literatures in the public domain, there are no descriptions found regarding improving of curling caused by adhesion and surface tack (Neppari) and improved ink acceptability at offset printing by coating an inorganic surface preparation agent mainly comprising silica sol on printing paper, particularly newsprint paper.

As mentioned above, recent trends in newsprint paper (lighter weight, or promotion of a high compounding ratio of DIP) have become great minus factors in terms of surface strength. To address the trends, increasing a coating quantity of a surface preparation agent has become necessary. If using a large quantity of a surface preparation agent such as starches, modified starches or polyvinyl alcohol, which have been commonly used, effects on improving surface strength were manifested. However, there were problems caused by surface tack (a phenomenon called "Neppari") in the newsprint paper manufacture process or when printing, because such surface preparation agents present surface tack when dampened by water. These Neppari problems were notably serious when coating the surface preparation agent was done by a coat transfer method such as a gate roller coater as compared with a case where a two-roll size press was used. Furthermore, in the case of four-color printing, because of dampening the same printing surface of newsprint paper with dampening solution four times, a water membrane was easily generated on the blanket and a paper surface, and a phenomenon of poor acceptability of hydrophobic ink was observed.

Additionally, if newsprint paper does not have water absorption resistance, dampening solution easily penetrates into the newsprint paper during offset printing. Due to this, the strength of a portion dampened decreases and this is more likely to result in web paper breaks (referred to as "paper breaks caused by dampening solution" hereinafter) by tension at printing. This has become an important issue. Furthermore, when reading printed newspaper, "strike through" implying that characters and color photograph images printed on the backside of the newsprint paper can be seen through is very troublesome. For coating by a film transfer method such as a gate roll coater, improving surface strength of newsprint paper (controlling a quantity of paper powder), improving water absorption resistance, lowering surface tack (Neppari), improving ink acceptability and strike through measures have been extremely important issues.

Regarding these issues, for example, in the Japanese Patent Laid-open No.1994-57688 journal and in the Japanese Patent Laid-open No.1994-192995 journal, surface tack eliminators for improving surface tack by adding it to a surface preparation agent were disclosed. In the Japanese Patent Laid-open No.1994-57688 journal, a surface tack eliminator comprising an organic fluoro compound was disclosed, and in the Japanese Patent Laid-open No.1994-192995 journal, a surface tack eliminator, in which substituted succinic acid and/or substituted succinic acid derivatives are active constituents, was disclosed. Since using these surface tack eliminators reduces Neppari, it is effective for increasing a coating quantity of a surface preparation agent. Regarding using these surface tack eliminators, however, it was found that there were problems such as: 1), effervescence at the time of coating is significant because a coating material comprises two constituents, a surface preparation agent and a surface tack eliminator, 2) cost increase, and 3) decreased black ink acceptability at color printing.

In the Japanese Patent Laid-open No.1993-59689 journal and the Japanese Patent Laid-open No.1993-296693 journal, sizing agents for paper comprising polyvinyl alcohol and a polyether compound were reported. Particularly in the former, Japanese Patent Laid-open No.1993-59689, a case that by coating a composition comprising a block copolymer of ethylene oxide and propylene oxide, and polyvinyl alcohol on base paper for newsprint, surface strength improves and newsprint paper with low tack at offset printing can be obtained, was disclosed. Although this composition was able to improve surface tack to a certain degree as compared with starches or polyvinyl alcohol coated independently, satisfactory ink acceptability and surface tack were not be able to be obtained if lighter paper and a higher DIP compounding ratio would further advance.

Consequently, the inventors of the present invention proposed use of colloidal silica as a surface preparation agent for newsprint paper in the Japanese Patent Laid-open No.1999-233238. If colloidal silica was used independently, excellent surface strength and surface tack (Neppari) were provided. However, due to low opacity, there was "strike through" problem implying that characters and color photograph images printed on the backside of newsprint paper can be seen through. Additionally, because printing ink acceptability is slightly inferior, there was a problem in finished print. For needs for providing offset paper having excellent high whiteness, surface tack (Neppari), water absorption resistance and ink acceptability as well as few strike through occurrence after offset printing, these problems were solved by providing a coating layer containing a surface preparation agent comprising two constituents, colloidal silica and inorganic salt.

BEST MODES FOR CARRYING THE INVENTION

Best modes for carrying the present invention are described below. To describe the best modes, newsprint paper which the present invention most effectively works on is used as an example.

Colloidal silica or silica sol used as a main constituent of an inorganic surface preparation agent according to the present invention is colloidal silica or silica sol that normally contains silicic anhydride by 30 to 40% and sodium by below 1% by converting the quantity into sodium oxide and with a pH value of 9.5 to 10.5. Silicic anhydride is in the form of $SiO_8.XH_8O$ in water dispersions and is of ultra-fine particles with a particle diameter of 4 to 100 nm, and the shape of the particle is spherical or linear. Because its particle diameter is very small, the particles can penetrate into a paper layer, and adsorption power or adhesive force between silica fine particles, and silica fine particles and pulp is strong. By coating this inorganic surface preparation agent mainly comprising colloidal silica or silica sol on base paper for newsprint, surface tack (Neppari) caused by dampening solution at offset printing notably decreases as compared with coating conventional water-soluble high polymer compounds. This is because the inorganic surface preparation agent comprising silica that has been dried once, different from an organic high polymer, does not dissolve or swell by water. Additionally, even if tacky substances are included in base paper for printing, the tacky substances are coated by a coated layer comprising silica, and curling caused by adhesion is believed to be controlled.

In the present invention, by adding an inorganic pigment to an inorganic surface preparation agent, ink acceptability is improved. Furthermore, offset paper with few troubles with surface tack and curling caused by adhesion and with low oxygen demand (COD) load in wastewater when recycled is obtained.

An inorganic pigment added to the inorganic surface preparation agent according to the present invention is an inorganic pigment such as calcium carbonate, kaolin, clay, talc, silica, white carbon, titanium oxide or hydrated dioxide, which is used as a filler or a pigment for regular papermaking. Titanium oxide is normally used for papermaking or a condenser. Titanium oxide and hydrated titanium oxide of specific gravity from approximately 3.8 to 4.2 are preferable. As to the morphology of a crystal, both a rutile type and an anatase type can be used. Although a quantity used of titanium oxide to colloidal silica fluctuates depending on a type of colloidal silica, composition of base paper, a quantity and a type of an internal sizing agent contained in the base paper, etc., use of 5 to 40 parts by weight to 100 parts by weight of the solid content in colloidal silica has maximum effects on opacity and prevention of strike through.

A compounding ratio of an inorganic pigment to the inorganic surface preparation agent according to the present invention fluctuates according to a type of colloidal silica, composition of base paper, a quantity and a type of an internal sizing agent contained in the base paper, etc. It is preferable to add 20 to 50 wt. % to the inorganic surface preparation agent. By mixing the inorganic pigment within the limits of 20 to 50 wt. %, a proper balance between opacity and surface tack of printing paper can be achieved.

In the present invention, by including inorganic salt in the surface preparation agent, offset paper with high whiteness, excellent surface tack, water absorption resistance and ink acceptability and with few strike through occurrences after offset printing can be obtained.

Inorganic salt contained in the surface preparation agent according to the present invention is salt obtained by neutralization of an acid and a base. In a solid state, it forms ionic crystal in many cases. Because it is preferable that the salt used in the present invention has a function for improving whiteness and opacity, a white crystal is most preferable. For inorganic salts, there are water-soluble inorganic salts and non-water-soluble inorganic salts. Water-soluble inorganic salt is preferable. Specifically, sodium sulfate, sodium chloride, magnesium chloride, sodium carbonate, calcium carbonate, sodium hydrogen carbonate, sodium phosphate, calcium phosphate, zinc sulfate, barium sulfate, aluminum sulfate, etc. can be mentioned. If considering cost and performance, sodium salts are preferable and sodium sulfate is most preferable. As for a ratio of an inorganic salt to colloidal silica, 5 to 250 parts by weight to 100 parts by weight of the solid content in colloidal silica is preferable. If the ratio is below 5 parts by weight, effects according to the present invention are reduced. If the ratio exceeds 250 parts by weight, characteristics of colloidal silica are lost.

In the present invention, the above-mentioned inorganic salt can be added to a colloidal silica solution when preparing a coating solution, or an inorganic salt generated as a by-product when producing colloidal silica can also be used.

In other words, colloidal silica used in the present invention is obtained as a colloidal solution of 10 to 20 nm using sodium silicate (liquid glass) as a raw material by reacting it with an inorganic acid such as sulfuric acid, hydrochloric acid, nitric acid, etc. at high temperatures and through silica particle growth by hydrolysis reaction and polymerization of silicic acid. At this reaction, inorganic salts such as sodium sulfate, sodium chloride, magnesium chloride, sodium nitrate, etc. are generated. Colloidal silica containing these inorganic salts can be used as a surface preparation agent. In this case, because desalting and refining are not performed, colloidal silica containing inorganic salts is obtained at low cost, and effects according to the present invention are worked on sufficiently.

Reasons for improved opacity by adding the above-mentioned inorganic salts and improved strike through have not been known, but can be estimated as follows: Water-soluble salts that are dissolving in a surface preparation agent solution separate out as microcrystals in the coating and drying processes as a water content decreases. These microcrystals exist stably by adsorbing or being bonded to colloidal particles of silicic acid anhyride (silica). The microcrystals separated out are generated not only on a paper surface but also inside the paper. It can be believed that, the microcrystals increase diffused reflection of light, improving opacity and strike through.

Furthermore, in the present invention, the above-mentioned effects can be further improved by adding an organic binder. As an organic binder used, starches such as starch, oxidized starch, oxygen denatured starch, dialdehyde starch, cation starch, hydroxyethyl starch and silicon denatured starch; water-soluble cellulose compounds such as carboxymethyl cellulose, methyl cellulose and hydroxyalkyl cellulose; polyvinyl compounds such as polyvinyl alcohol; water-soluble organic binders such as polyacrylamide, silicon denatured polyacrylamides and casein; synthetic resin latex obtained as a polymer from monomers such as styrene, butadiene, methyl methacrylate and acrylonitrile can be mentioned. As for a ratio of the above-mentioned organic binder to colloidal silica, a ratio of 5 to 2000 parts by weight of the organic binder to 100 parts by weight of the solid content in colloidal silica is preferable. The ratio of 5 to 100 parts by weight is particularly preferable. If the ratio is below 5 parts by weight, effects of the present invention are reduced. If the ratio exceeds 2000 parts by weight , original characteristics of colloidal silica are lost.

By adding a surface-sizing agent, offset paper with low paper powder accumulation at offset printing can be obtained. As a surface-sizing agent, rosin, rosin emulsion, paraffin wax emulsion, alkyl ketene dimer, alkenyl succinic acid anhdride, silicon resin emulsion, styrene-acrylic acid copolymer, styrene-maleic acid copolymer, vinyl acetate-maleic acid copolymer, styrene-acrylic acid-acrylate copolymer, styrene-maleic acid-maleate copolymer and olefin-maleic acid copolymer can be mentioned. Among them, styrene-acrylic acid copolymer, styrene-maleic acid copolymer, vinyl acetate-maleic acid copolymer and olefin-maleic acid copolymer are particularly excellent.

As for a desired quantity of the above-mentioned surface-sizing agent to colloidal silica, 5 to 30 wt. % is preferable. If the desired quantity is below 5 wt. %, sufficient water absorption resistance is not provided. If the desired quantity exceeds 30 wt. %, original characteristics of colloidal silica are lost.

For the inorganic surface preparation agent according to the present invention, inorganic materials and a small quantity of organic materials such as organic starch, modified starch, polyacrylamide and plyvinyl alcohol can be mixed within the limits not decreasing surface tack. However, use of organic materials should be limited to the minimum, because adding organic materials increases COD loads.

Base paper for newsprint used in the present invention is manufactured from mechanical pulp (MP) such as groundwood pulp (GP), thermomechanical pulp (TMP) and semi-chemical pulp, chemical pulp (CP) such as kraft pulp (KP) and/or deinked pulp (DIP), which is obtained by deinking used papers containing these different types of pulp or recycled pulp obtained by defibrating brokes from the paper-making process, by using one kind of pulp or by mixing different kinds of pulp at a given ratio. Base paper for newsprint with which effects according to the present invention are most noticeable is the paper made to 37 $g/m^2$ to 43 $g/m^2$ in basis weight. In the case of base paper of basis weight above 46 $g/m^2$, the paper is considered to possess sufficient surface strength. Since there may be changes in paper dimensions caused by dampening solution at offset printing or lowered surface strength may be within a negligible range, it is not always necessary to improve surface strength by adding a chemical externally.

As to a compounding ratio of DIP for the base paper used in the present invention, DIP can be mixed within a given range (0 to 100 wt. %). Considering recent trends in high DIP compounding ratios, a range of 30 to 100 wt. % per total pulp constituents is preferable. The present invention is effective particularly on base paper in which 70 wt. % and more of DIP is mixed. As mentioned above, DIP manufactured from magazine recycled waste paper containing tacky substances can be used.

To this base paper for newsprint, inorganic fillers such as white carbon, clay, kaolin, silica, talc, titanium oxide and calcium carbonate or organic fillers manufactured from synthetic resins (vinyl chloride resin, polystyrene resin, urea formalin resin, melamine resin, styrene/butadiene copolymer resin, etc.) can be internally added as a filler. Calcium carbonate is effective particularly on neutral paper.

According to need, paper strength promoters such as polyacrylamide high polymer, polyvinyl alcohol high polymer, cationized starch and urea/formalin resin; drainage or yield improvers such as salt that is a copolymerized material of acrylamide and aminomethyl acrylamide, cationized starch, polyethyleneimine, polyethylene oxide and acrylamide/sodium acrylate copolymerized material; sizing agents such as strengthened a rosin sizing agent (a solution obtained by adding maleic anhydride or fumaric anhydride to rosin resolved to be partially maleylated or to be partially fumaric acid, then by conducting complete saponification by alkali), an emulsion sizing agent (obtained by dispersing rosin resolved to be partially maleylated or to be partially fumaric acid in water using rosin soap or various surface active agents as an emulsifying agent), synthetic sizing agents (sizing agents using petroleum resin made by copolymerizing C3 to C10 obtained from naphtha distillate) and reactive sizing agents (AKD, alkenyl succinic acid anhydride); and/or auxiliaries such as aluminum sulfate (sulfate band), a waterproof agent, a UV rays protective agent and a color preserving agent can be contained. If considering recycling efficiency, auxiliaries that can reduce COD loads as much as possible are preferable. The base paper should have physical properties for printability with an offset press, and should have tensile strength, tear resistance and stretch that regular newsprint paper has.

The base paper for newsprint used in the present invention can be either of acidic, neutral or alkaline newsprint paper.

In the surface preparation agent according to the present invention, to fit in desired physical properties within the limits not impairing the purposes of the present invention, it is permissible to use with inorganic pigments and other surface preparation agents.

The newsprint paper according to the present invention is made by coating a coating solution containing the surface preparation agent according to the present invention on one side or on both sides of base paper for newsprint using an on-machine coater such as a gate roll coater.

A coating quantity of the inorganic surface preparation agent according to the present invention should be determined according to the degree of surface strength needed to be provided for printing paper to be made, and should not be particularly limited. However, from a viewpoint of surface strength needed, the surface preparation agent according to the present invention effectively displays effects when a coating quantity, i.e., a total quantity of solid contents of silica sol or colloidal silica and an inorganic pigment, is within the limits of 0.1 to 1.0 g/m$^2$ (per both sides). If the coating quantity is below 0.1 g/m$^2$, it does not give sufficient effects on improving ink acceptability, preventing paper powder from falling off, and lowering tack against tacky substances on a paper surface. If increasing the coating quantity above 1.0g/m$^2$, effects for lowering the tack reach the peak and it becomes wasteful cost-wise due to increased drying loads. Considering the application of the surface preparation agent to newsprint paper, as mentioned above, it is preferable to improve the balance between surface strength and surface tack only by the composition of an inorganic surface preparation agent. If taking these two points collectively into consideration, for the coating quantity of the composition, within the limits of 0.3 to 1.0 g/m$^2$ (per both sides) is most preferable.

The newsprint paper according to the present invention is made by coating a coating solution containing the surface preparation agent according to the present invention on one side or on both sides of base paper for newsprint using a coater. As a coater, it is preferable to use a film-transfer type coater such as a gate roll coater, a blade metaling coater and a rod metaling coater. Particularly, using a gate roll coater has a dramatic effect. In other words, as mentioned above, surface preparation agents conventionally used had a problem with surface tack using a gate roll coater if sufficient surface strength was given. The surface preparation agent according to the present invention, however, using a gate roll coater, can efficiently improve surface tack as well as surface strength by on-machine-coating the surface preparation agent at a coating speed within the limits of 800 to 1800 m/min.

Since the surface preparation agent according to the present invention has also excellent coating suitability for using a gate roll coater, it is most preferable to coat both sides using a gate roll coater. From a productivity point of view, an on-machine coater is preferable.

In the case of newsprint paper, smoothness of a paper surface is low, hence it has been thought that it is difficult to provide an inorganic barrier layer on the paper surface externally (particularly using a gate roll coater) in an area where a coating quantity applied is low. The surface preparation agent according to the present invention, however, has an excellent characteristic in that it improves surface strength and ink acceptability with low surface tack at a high papermaking speed of 600 to 1800 m/min., even in a relatively low coating quantity.

For the newsprint paper on which the inorganic surface preparation agent according to the present invention is coated, lowering friction coefficients is not observed. Consequently, no anti slip agent needs to be blended. When applying the surface preparation agent to newsprint paper, it is preferable that the dynamic fiction coefficient of the newsprint paper to be manufactured is within the limits of 0.40 to 0.70.

Because the newsprint paper on which the inorganic surface preparation agent according to the present invention is coated can control surface strength over a large area, it can extensively accommodate various types of ink used for printing. For example, it is possible to accommodate special ink such as emulsion ink in which dampening solution is mixed in oil-based ink and ink for waterless surface printing with high tack.

As mentioned above, improving newsprint paper is difficult as compared with improving one sheet of high-quality printing paper. For this reason, converting technologies for general printing paper directly to technologies for newsprint paper is difficult. However, converting technologies for newsprint paper to technologies for general printing paper is conversely relatively easy. Therefore, applying the inorganic surface preparation agent according to the present invention to general printing paper is possible, not limiting to newsprint paper, and providing the same effects as does on the newsprint paper.

EMBODIMENTS

The present invention is described below in detail following embodiments and comparative examples, but the present invention is not limited to those examples.

In the description below, parts and wt. % indicate parts by weight and weight percent respectively.

Preparation of Coating Solution: Constituent A

The inorganic surface preparation agent according to the present invention was prepared by diluting silica sol aqueous solution applicable to Constituent A of the present invention to the prescribed concentration.

Coating solutions that are emulsified or generate insoluble precipitates when diluting the silica sol aqueous solution are not preferable for gate roll coating. A coating solution that becomes slurry while the coating solution repeatedly goes through the roll for a long period of time is not preferable as well. Given this factor, a gum-up test was conducted for a solution prepared by diluting Constituent A to the prescribed concentration by performing mechanical share (1000 rotations, 30 minutes) using a test machine (manufactured by Kumagai Riki) and no gum up was observed. Consequently, the inorganic surface preparation agent containing silica sol was found to have excellent suitability for a coating solution for a gate roll coater.

Making of Base Paper for Newsprint

Unsized and non-calendered base paper for newsprint was made from mixed pulp prepared by mixing and defibrating raw materials in the proportion of 35 parts of DIP (deinked pulp), 30 parts of TMP (Thermomechanical Pulp), 20 parts of GP (Grand Pulp) and 16 parts of KP (Kraft Pulp), with freeness of 200 ml using a Bel-Baie former type paper manufacturing machine at a papermaking speed of 1100 m/min to 1200 m/min. This base paper was of 43 g/m$^2$ in basis weight, 0.65 g/cm$^3$ in density, 51% in whiteness, 60 sec. in smoothness, a static friction coefficient of 0.45 and a dynamic friction coefficient of 0.56, and was the same newsprint paper as general newsprint paper. Additionally, this base paper did not contain an internal sizing agent and its water absorption resistance was 5 to 7 sec. by a drop/water adsorption method.

For measuring a coating quantity, surface strength, peel strength, ink acceptability, a COD quantity, drop/water adsorption degree, a paper powder quantity, surface tack, paper breaks caused by dampening solution, opacity and whiteness, methods described below were used.

1) Measuring of a coating quantity: A coating quantity of silica sol was calculated, considering the thickness of a solution coat on the applicator roll as 1.2$\mu$ and a shifting ratio as 95%. A coating quantity of a starch was extracted by cutting out a sample of 10×10 cm, putting it in distilled water of 50 ml and maintaining it in boiling water for one hour. After filtering it, filtered liquid was diluted to 100 ml, and 10 ml of 100 ml was sampled. For starch, 2.5 ml of 2N-hydrochloric acid and 2.5 ml of potassium iodide/Iodine solution were added and the total quantity was diluted to 50 ml. By measuring absorbance of 58 nm, a starch quantity was calculated by an analytical curve created in advance. For polyacrylamide, the nitrogen content of a sample was obtained by the Kjeldahl method and a value obtained was converted.

2) Measuring of surface strength: 10,000 copies were printed using an Apollo printing press, and a quantity of paper powder accumulated on the non-printed area of a blanket is evaluated visually.

Evaluation Criteria

○: Generation of paper powder is slightly observed, but it does not cause any difficulty for a practical standpoint.

Δ: Generation of paper powder is clearly observed.

×: Paper powder accumulates and the non-printed area of the blanket appears to be white.

3) Measuring of peel strength: By cutting out two sheets of newsprint paper to a size of 4×6 cm and after dipping them in water at 20° C. for five seconds, the coated sides of two sheets were stuck together. By putting newsprint paper on top of both outside surfaces of the sheet, the sheet was smoothed with a roller at a stress of 50 Kg/cm and was conditioned at 25° C. and 60% relative humidity for 24 hours. After sizing the sheet to a test piece of 3×6 cm, the test piece was measured under the condition of a tensile speed of 30 mm/min. using a tensile tester.

A high value of initial peel strength was used as a peak value. The next stable value of peel strength was used as a stable value. The higher a measured peel strength value is, the more difficult peeling becomes (On the contrary, surface tack is stronger.). For the newsprint paper according to the present invention, evaluation was made using stable values of peel strength, and those with stable values of peel strength below 15.0 gf/3 cm were determined as "having satisfactory peeling property, i.e., less surface tack".

4) Measuring of ink acceptability: Ink acceptability was measured by a Prufbau printing tester. By laying a given quantity of black ink on a rubber roll of the Prufbau printing tester, newsprint paper (with a printing area of 4×20 cm) was printed at a printing pressure of 15 N/m and a printing speed of 6.0 m/sec. At this time, dampening solution contacts the 2×20 cm central portion of the newsprint paper and that portion was printed in 0.15 sec. The print density of the printed areas on both ends which the dampening solution did not moisten (DRY printed portions) and the central printed area which the dampening solution moistened (a WET printed portion) was measured using a Macbeth densitometer. Ink acceptability was evaluated using a value obtained by subtracting a WET print density value from a DRY print density value. Namely, the smaller this print density difference is, the smaller a difference between a DRY print density and a WET print density is, which implies that the WET printed portion is not very much affected by the dampening solution. The larger the difference is, the more inferior ink acceptability is due to the WET print portion affected by the dampening solution.

5) Measuring of COD: Following JIS K 0101 "17, Oxygen Demand by Potassium Permanganate ($COD_{Ma}$) at 100° C., newsprint paper 43 g was re-defibrated in 1 Kg of water and COD contained in filtrate was measured.

6) Measuring of drop/water absorption degree: Drop/water absorption degree was measured using a method for measuring a drop/water absorption degree pursuant the Japan TAPPI No.33. By dropping 1 $\mu$l of distilled water on the F surface of the newsprint paper on which the surface preparation agent was coated, time until a droplet was absorbed in the paper surface was measured. The larger a drop/water absorption degree is, the higher water absorption resistance is, the less penetration of the dampening solution from the surface of the newsprint paper to inside the base paper becomes, and the more difficult it becomes to cause paper breaks caused by dampening solution.

7) Measuring of a paper powder quantity: A paper powder quantity was measured using an offset type Apollo printing press. 20,000 copies were printed on the F surface of the newsprint paper on which the surface agent was coated by monochromatic printing. Black ink was used. The print density of an image portion after the printing was set at 1.20 and a film thickness of the dampening solution on a plate was adjusted at 1.7$\mu$. The blanket was collected after printing was completed and paper powder accumulated on the blanket was weighed by dampening the paper powder with distilled water and collecting dampened paper powder by removing it using a toothbrush. A paper powder quantity per 100 $cm^2$ was calculated.

8) Measuring of a coating quantity: A coating quantity was calculated by measuring the film thickness of a coating solution on an applicator roll and using a transfer rate of 95%.

9) Measuring of surface tack: By cutting out two sheets of newsprint paper to a size of 4×6 cm and after dipping them in water at 20° C. for five seconds, the coated side of two sheets were stuck together. By putting newsprint paper on top of both outside surfaces of the sheet, the sheet was smoothed with a roller at a stress of 50 Kg/cm and was conditioned at 25° C. and 65% RH for 24 hours. After sizing the sheet to a test piece of 3×6 cm, by gripping an upper portion of 2 cm, which was not dipped in water, using a tester's clamp, the test piece was peeled under the condition of a tensile speed of 30 mm/min and in the 180-degree direction. A high value of initial peel strength was used as a peak value. The next stable value of peel strength was used as a stable value. The higher a measured peel strength value is, the more difficult peeling becomes (i.e., surface tack is stronger.). For the newsprint paper according to the present invention, those with stable values of peel strength below 15.0 gf/3 cm were determined as "having satisfactory peeling property, i.e., less surface tack".

10) Measuring of paper breaks caused by dampening solution: Because it was impossible to directly determine paper breaks caused by dampening solution, the paper breaks were evaluated by water absorption resistance using the drop/water absorption method. The method for measuring a drop/water absorption degree pursuant the Japan TAPPI No.33 was used. By dropping 1 $\mu$l of distilled water on the F surface of the newsprint paper on which the surface preparation agent was coated, time until a droplet was absorbed in the paper surface was measured. The larger a drop/water absorption degree is, the higher water absorption resistance is, the less penetration of the dampening solution from the surface of the newsprint paper to inside the base paper during offset printing becomes, and the more difficult it becomes to cause paper breaks caused by dampening solution.

11) Measuring of opacity: Opacity was measured based on JIS P 8138 using a Hunter reflectometer. By measuring a reflectivity $R_{0.89}$(illegible) when a newsprint paper test piece was put on top of a white plate (reflectivity: 89%) and a reflectivity $R_0$ when a newsprint paper test piece was put on top of a black plate (reflectivity: below 0.5%), opacity (%) was calculated using the following formula:

$$\text{Opacity } (\%) = R0/R0.89 \times 1000$$

12) Measuring of whiteness: Whiteness was measured based on JIS P 8123 using a Hunter whiteness meter. By exposing a newsprint paper test piece to light from a light source (a tungsten lamp) through a blue filter and at an angle of 45°, reflected light was received at an angle of 0°. Whiteness was indicated in reflectivity by contrast with the standard whiteness, which takes the reflectivity of magnesium oxide for 100.

Embodiments 1 to 3

As Constituent A, three different coating solutions were prepared by diluting silica sol (Product name: Snowtex 40 produced by Nissan Chemical Ind.) aqueous solution to a concentration of 5.0%, 10.0% and 23.5% (solid content wt. %) respectively. These coating solutions were coated respectively on the F surface of the above-mentioned base paper for newsprint using a gate roll coater at a coating speed of 300 m/min. After coating the solutions, super-calendering was performed, and three different types of newsprint paper with a different coating quantity coated respectively were made. Regarding these newsprint papers, a coating quantity, peel strength, ink acceptability, static/dynamic friction coefficients and COD were measured in the methods described below and results are shown in Table 1.

Comparative Example 1

The base paper for newsprint used in Embodiment 1 was super-calendered and a coating quantity, peel strength, ink acceptability, static/dynamic friction coefficients and COD were measured. Results are shown in Table 2.

Comparative Example 2

In place of the silica sol used in Embodiment 1, 10% aqueous solution of polyacrylamide (Product name: P-120 produced by Seiko Chemical Industries) was coated on the F surface using a gate roll coater at a coating speed of 300 m/min. After coating the solution, super-calendering was performed, and newsprint paper was obtained. Regarding this newsprint paper, a coating quantity, peel strength, ink acceptability, static/dynamic friction coefficients and COD were measured. Results are shown in Table 2.

Comparative Example 3

In place of the silica sol used in Embodiment 1, 10% aqueous solution of oxidized starch (Product name: SK-20 produced by Japan Cornstarch Co.) was coated on the F surface using a gate roll coater at a coating speed of 300 m/min. After coating the solution, super-calendering was performed, and newsprint paper was obtained. Regarding this newsprint paper, a coating quantity, peel strength, ink acceptability, static/dynamic friction coefficients and COD were measured. Results are shown in Table 2.

TABLE 1

| | Coating Qty. | Surface | Peel Strength | Ink Acceptability | | Static Friction | Dynamic Friction | COD |
|---|---|---|---|---|---|---|---|---|
| | ($g/m^2$) | Strength | (gf/3 cm) | Dry | Wet | Coefficient | Coefficient | (mg/ml) |
| Embodiment 1 | 0.11 | ○ | — | 1.20 | 1.17 | 0.75 | 0.65 | 0.12 |
| Embodiment 2 | 0.23 | ○ | — | 1.21 | 1.18 | 0.74 | 0.61 | 0.13 |
| Embodiment 3 | 0.56 | ○ | — | 1.20 | 1.17 | 0.71 | 0.60 | 0.13 |
| Comparative Example 1 | 0 | x | — | 1.20 | 1.17 | 0.58 | 0.48 | 0.13 |
| Comparative Example 2 | 0.09 | Δ | 20 | 1.20 | 1.11 | 0.57 | 0.49 | 0.22 |
| Comparative Example 3 | 0.48 | ○ | 25 | 1.20 | 1.08 | 0.56 | 0.47 | 0.37 |

Results Shown in Table 1

As shown in Table 1, there was no problem in surface strength of the newsprint papers in Embodiments 1 to 3 from a practical standpoint. For the test results of the ink acceptability of the newsprint paper, a difference between a print density when printing without dampening the newsprint paper (dry) and a print density when printing with dampening the newsprint paper (wet) was small, hence wet ink acceptability improved. Wet ink acceptability after dampening the newsprint papers by Prufbau in Embodiments 1 to 3 was at higher levels as compared with Comparative Examples 1 to 3. The newsprint papers in Embodiments 1 to 3 did not show surface tack, and it was impossible to measure the peel strength. Static and dynamic friction coefficients improved. Based on the ink acceptability test of these newsprint papers, it was proved that the surface preparation agent mainly comprising silica sol (which contains other inorganic materials such as titanium) was excellent in terms of printing workability. A COD quantity contained in filtrate of the newsprint papers in Embodiments 1 to 3 was measured in the test, and the quantity was nearly the same as the measured value from Comparative Example 1. However, the COD quantity corresponding to the coating quantity did not increase. More specifically, when recycled, a COD load in wastewater did not increase.

On the contrary, for the newsprint papers in Comparative Examples 1 to 3, a difference between a print density when printing without dampening the newsprint paper (dry) and a print density when printing with dampening the newsprint paper (wet) was large, hence wet ink acceptability was inferior. A COD quantity contained in filtrate of the newsprint papers in Comparative Examples 1 to 3 was measured in the test, and the COD quantity corresponding to the coating quantity increased. More specifically, when recycled, a COD load in wastewater increased.

The wet ink acceptability of the base paper for newsprint in Comparative Example 1 was good. However, its surface strength was weak and a paper powder quantity fallen off at the time of long-run printing was large. The newspaper was not suitable for practical use.

Embodiment 4

Dispersion liquid was prepared by mixing 10% silica sol aqueous solution (Product name: Snowtex 40 produced by Nissan Chemical Ind.) as Constituent A, and titanium oxide (Product name: Taipaque W-10 produced by Ishihara Sangyo, X-ray particle diameter: 150 nm) as Constituent B in the solid-content proportion one to one. By diluting the dispersion liquid, a coating solution with 6% solid-content concentration containing Constituents A and B was prepared. The coating solution obtained was coated on the F surface of the above-mentioned newsprint paper using a plain meyer bar. After coating the surface, super-calendering was performed and newsprint paper was made. A coating quantity, peel strength and opacity were measured, and the results are shown in Table 2.

Embodiment 5

Dispersion liquid was prepared by mixing 10% silica sol aqueous solution (Product name: Snowtex 40 produced by Nissan Chemical Ind.) as Constituent A, and light calcium carbonate (Product name: Brilliant 15 produced by Siraisi Ind.) as Constituent B in the solid-content proportion one to one. By diluting the dispersion liquid, a coating solution with 6% solid-content concentration containing Constituents A and B was prepared. The coating solution obtained was coated on the F surface of the above-mentioned newsprint paper using a plain meyer bar. After coating the surface, super-calendering was performed and newsprint paper was made. A coating quantity, peel strength and opacity were measured, and the results are shown in Table 2.

Embodiment 6

Dispersion liquid was prepared by mixing 10% silica sol aqueous solution (Product name: Snowtex 40 produced by Nissan Chemical Ind.) as Constituent A, and white carbon (Product name: Nipple E-75 produced by Nippon Silica) as Constituent B in the solid-content proportion one to one. By diluting the dispersion liquid, a coating solution with 6% solid-content concentration containing Constituents A and B was prepared. The coating solution obtained was coated on the F surface of the above-mentioned newsprint paper using a plain meyer bar. After coating the surface, super-calendering was performed and newsprint paper was made. A coating quantity, peel strength and opacity were measured, and the results are shown in Table 2.

Comparative Example 4

The newsprint paper used in Embodiment 1 was super-calendered. Peel strength and opacity were measured, and the results are shown in Table 2.

Comparative Example 5

Regarding the newsprint paper used in Embodiment 1, silica sol aqueous solution with a concentration of 6% (Product name: Snowtex 40 produced by Nissan Chemical Ind.) was coated on the F surface of the above-mentioned newsprint paper using a plain meyer bar. After coating the surface, super-calendering was performed. A coating quantity, peel strength and opacity were measured, and the results are shown in Table 2.

TABLE 2

| | Coating Qty. ($g/m^2$) | Peel Strength (g/3 cm) | Opacity (%) |
|---|---|---|---|
| Embodiment 4 | 0.7 | — | 88.4 |
| Embodiment 5 | 0.8 | — | 88.5 |
| Embodiment 6 | 0.9 | — | 88.7 |
| Comparative Example 4 | — | — | 87.0 |
| Comparative Example 6 | 0.5 | — | 87.0 |

Results Shown in Table 2

As shown in Table 2, the newsprint papers in Embodiments 4 to 6, on which the surface preparation agent comprising silica sol and an inorganic pigment was coated, did not show any surface tack, and it was impossible to measure peel strength. Even though a coating quantity was very small, improved opacity was observed.

The newsprint paper in Comparative Example 5, on which the surface preparation agent comprising only silica sol was coated, did not show surface tack. However, it is clear as compared with Comparative Example 4, no improvement in opacity was observed.

Evaluation of Prevention of Curling Caused by Adhesion

The following experiment was conducted to test to what extent the surface preparation agent according to the present invention has prevention effects against curling caused by adhesion.

On the above-mentioned base paper for newsprint, as an adhesive material, an acrylic adhesive (Product name: GH451 produced by Saiden Chemical Ind.), which is normally used as a glue for the back of a magazine, and vinyl acetate adhesive (Product name: GH451 produced by Saiden Chemical Ind.) were coated using a plain bar in a coating quantity of 1.5 $g/m^2$ respectively. On the base paper for newsprint, on which two kinds of adhesives were coated, silica sol aqueous solution (Product name: Snowtex 40 produced by Nissan Chemical Ind.) was coated using a plain bar in two different coating quantities, 0.1 $g/m^2$ and 0.5 $g/m^2$. For comparison, the newsprint paper on which nothing was coated on its adhesive-coated surface, and the newsprint paper on which oxidized starch (Product name: SK-20 produced by Japan Cornstarch Co.) aqueous solution was coated using a plain bar in a coating quantity of 0.5 $g/m^2$ was made. The coated sides of the newsprint paper were stuck together using a roll at a pressure of 50 $Kg/m^2$. Test pieces of 3×6 cm each were made. Peel strength was measured using a tensile tester at a tensile speed of 30 mm/min, and stable peel strength values are shown in Table 3.

TABLE 3

| Surface Preparation Agent | Coating Qty. (gf/3 cm) | Peel Strength (Acrylic adhesive coated) | Peel Strength (vinyl acetate adhesive coated) |
|---|---|---|---|
| Silica sol | 0.1 | — | — |
| Silica sol | 0.5 | — | — |
| Uncoated | 0 | 141 | 32 |
| Oxidized starch | 0.5 | 130 | 42 |

As shown in Table 3, because the silica sol coated newsprint paper did not show surface tack, it was impossible to measure peel strength. In other words, even with paper containing a large quantity of tacky substance, curling caused by adhesion could be controlled.

Regarding the newsprint paper made, surface tack was evaluated by measuring peel strength, and water absorption resistance was evaluated by measuring drop/water absorption degree. A coating quantity, ink acceptability and a paper powder quantity were also measured.

Embodiment 7

Colloidal silica aqueous solution was prepared by diluting 40% aqueous solution of colloidal silica (Product name: Snowtex ST40 produced by Nissan Chemical Ind.) to a solid-content concentration of 10%. As a surface-sizing agent, 10% aqueous solution of styrene-acrylic acid copolymer (Product name: Colopearl M-305 produced by Seiko Chemical Ind.) was prepared. By mixing colloidal silica aqueous solution and the surface-sizing agent in the addition ratio of 25 wt. % of the surface-sizing agent to the colloidal silica, a surface preparation agent with a concentration of 10% was prepared. The surface preparation agent obtained was coated on the F surface of the base paper for newsprint using a gate roll coater at a coating speed of 1000 m/min, super-calendering was performed, and newsprint paper was obtained. Regarding this newsprint paper, a coating quantity, peel strength, drop/water absorption degree, ink acceptability and a paper powder quantity were measured, and the results are shown in Table 4.

Embodiment 8

Newsprint paper was made in the same way as applied to Embodiment 7 except that 10% aqueous solution of alkyd resin (Product name: Size-up 411K produced by Arakawa Chemical Ind.) was used as a surface-sizing agent, in place of styrene-acrylic acid copolymer. Regarding the newsprint paper obtained, a coating quantity, peel strength, drop/water absorption degree, ink acceptability and a paper powder quantity were measured, and the results are shown in Table 4.

Embodiment 9

Newsprint paper was made in the same way as applied to Embodiment 7 except that 10% aqueous solution of styrene-maleic acid copolymer (Product name: Colopearl M-300 produced by Seiko Chemical Ind.) was used as a surface-sizing agent, in place of styrene-acrylic acid copolymer. Regarding the newsprint paper obtained, a coating quantity, peel strength, drop/water absorption degree, ink acceptability and a paper powder quantity were measured, and the results are shown in Table 4.

Embodiment 10

Newsprint paper was made in the same way as applied to Embodiment 7 except that 10% aqueous solution of olefin-maleic acid copolymer (Product name: Polymalon 482 produced by Arakawa Chemical Ind.) was used as a surface-sizing agent, in place of styrene-acrylic acid copolymer. Regarding the newsprint paper obtained, a coating quantity, peel strength, drop/water absorption degree, ink acceptability and a paper powder quantity were measured, and the results are shown in Table 4.

Embodiment 11

Dispersion liquid with a concentration of 12% was prepared by mixing titanium oxide (Product name: Taipaque W-10 produced by Ishihara Sangyo, X-ray particle diameter: 150 nm) and 10% colloidal silica aqueous solution (Product name: Snowtex ST-40 produced by Nissan Chemical Ind.) in the solid-content ratio of one to five. As a surface-sizing agent, 10% aqueous solution of styrene-acrylic acid copolymer (Product name: Colopearl M-305 produced by Seiko Chemical Ind.) was prepared. By mixing the dispersion liquid and the surface-sizing agent and diluting the mixture with water, a surface preparation agent with a concentration of 10% was prepared in the addition ratio of 25 wt. % of the surface-sizing agent to the colloidal silica. Newsprint paper was made in the same way as applied to Embodiment 7 except that the surface preparation agent obtained was used. Regarding this newsprint paper obtained, a coating quantity, peel strength, drop/water absorption degree, ink acceptability and a paper powder quantity were measured, and the results are shown in Table 4.

Embodiment 12

Colloidal silica aqueous solution was prepared by diluting 40% aqueous solution of colloidal silica (Product name: Snowtex ST-40 produced by Nissan Chemical Ind.) with water to a solid-content concentration of 10%. As a surface-sizing agent, 10% aqueous solution of styrene-acrylic acid copolymer (Product name: Colopearl M-305 produced by Seiko Chemical Ind.) was prepared. 10% aqueous solution of cationic polyacrylamide (Product name: Harmide produced by Harima Chemicals Inc.) was prepared. By mixing the three aqueous solutions prepared, a surface preparation agent with a concentration of 10% was prepared in the addition ratio of 25 wt. % of both the surface-sizing agent and cationic polyacrylamide to the colloidal silica. Newsprint paper was made in the same way as applied to Embodiment 7 except that the surface preparation agent obtained was used. Regarding this newsprint paper obtained, a coating quantity, peel strength, drop/water absorption degree, ink acceptability and a paper powder quantity were measured, and the results are shown in Table 4.

Comparative Example 6

Newsprint paper was made in the same way as applied to Embodiment 7 except that a surface preparation agent prepared by diluting 40% aqueous solution of colloidal silica (Product name: Snowtex ST40 produced by Nissan Chemical Ind.) with water to a solid-content density of 10% was used. Regarding this newsprint paper obtained, a coating quantity, peel strength, drop/water absorption degree, ink acceptability and a paper powder quantity were measured, and the results are shown in Table 4.

Comparative Example 7

Newsprint paper was made in the same way as applied to Embodiment 7 except that styrene-acrylic acid copolymer (Product name: Colopearl M-305 produced by Seiko Chemical Ind.) was used as a surface preparation agent. Regarding this newsprint paper obtained, a coating quantity, peel strength, drop/water absorption degree, ink acceptability and a paper powder quantity were measured, and the results are shown in Table 4.

Comparative Example 8

10% aqueous solution of oxidized starch (Product name: SK-20 produced by Japan Cornstarch Co.) was prepared. As a surface-sizing agent, 10% aqueous solution of styrene-acrylic acid copolymer (Product name: Colopearl M-305 produced by Seiko Chemical Ind.) was prepared. By mixing the oxidized starch and the surface-sizing agent in the weight ratio 4 to 1, a surface preparation agent with a solid-content concentration of 10% was obtained. Newsprint paper was made in the same way as applied to Embodiment 7 except that the surface preparation agent obtained above was used as a surface preparation agent. Regarding this newsprint paper obtained, a coating quantity, peel strength, drop/water absorption degree, ink acceptability and a paper powder quantity were measured, and the results are shown in Table 4.

Comparative Example 9

Newsprint paper was made in the same way as applied to Embodiment 7 except that 10% aqueous solution of oxidized starch (Product name: SK-20 produced by Japan Cornstarch Co.) was used as a surface preparation agent. Regarding this newsprint paper obtained, a coating quantity, peel strength, drop/water absorption degree, ink acceptability and a paper powder quantity were measured, and the results are shown in Table 4.

TABLE 4

| | Coating Qty/ ($g/m^2$) | Peel Strength (mN/3 cm) | Drop/Water Absorption (sec.) | Ink Accept-ability | Paper Powder Qty. ($mg/100\ cm^2$) |
|---|---|---|---|---|---|
| Embodiment 7 | 0.31 | 19.6 | 50 | 0.03 | 20 |
| Embodiment 8 | 0.32 | 9.8 | 42 | 0.03 | 22 |
| Embodiment 9 | 0.30 | 19.6 | 41 | 0.02 | 21 |
| Embodiment 10 | 0.32 | 9.8 | 40 | 0.03 | 18 |
| Embodiment 11 | 0.33 | 4.9 | 45 | 0.02 | 20 |
| Embodiment 12 | 0.34 | 9.8 | 55 | 0.02 | 15 |
| Comparative Example 6 | 0.32 | 19.8 | 6 | 0.08 | 30 |
| Comparative Example 7 | 0.30 | 294.2 | 16 | 0.12 | 150 |
| Comparative Example 8 | 0.34 | 274.6 | 16 | 0.13 | 70 |
| Comparative Example 9 | 0.32 | 245.2 | 8 | 0.12 | 70 |

Results Shown in Table 4

As shown in Table 4, it was observed that the newsprint papers in Embodiments 7 to 10, on which colloidal silica and the surface preparation agent were coated, had low peel strength, lowered surface tack, high drop/water absorption degrees, improved water absorption resistance, further low paper powder quantity and excellent ink acceptability. The newsprint paper in Comparative Example 6, on which only colloidal silica was coated, had low peel strength, low drop/water absorption degree, insufficient water absorption resistance and slightly poor ink acceptability. The newsprint paper In Comparative Example 7, on which only the surface-sizing agent was coated, was inferior in all of peel strength, ink acceptability and the paper powder quantity. For the newsprint paper in Comparative Example 8, on which the oxidized starch and the surface preparation agent were coated, and the newsprint paper in Comparative Example 9, on which on the oxidized starch was coated, there were problems in peel strength, water absorption resistance, ink acceptability and the paper powder quantity.

A stable peel strength value of the newsprint paper in Embodiment 11, for which titanium oxide was added to the surface preparation agent, was 0.5 gf/3 cm. By adding titanium oxide, peel strength further decreased. In Comparative Example 9, for which only the oxidized starch was added, lowered opacity was observed. However, in Embodiment 1, opacity improved.

As for dynamic/static friction coefficients of the newsprint papers obtained, for example, in the case of the newsprint paper in Embodiment 11, a dynamic friction coefficient was 0.60 and a static friction coefficient was 0.56. As against it, in the case of newsprint paper in Comparative Example 9, a dynamic friction coefficient was 0.51 and a static friction coefficient was 0.50. Dynamic/static friction coefficients of the newsprint papers, on which the surface preparation agent according to the present invention was coated, improved. Dynamic/static friction coefficients were measured pursuant to Japan TAPPI NO.30-79 (The test method for friction coefficients of paper and paperboard).

Furthermore, regarding newsprint paper made according to the following formulas, a coating quantity, surface tack, paper breaks caused by dampening solution, ink acceptability and whiteness were measured, and overall quality evaluation of the newsprint papers was made using the following ratings:

◎: Very good, ○: Good, Δ: Poor, ×:Very poor

Making of Base Paper for Newsprint

By mixing and defibrating 70 parts of DIP (deinked pulp), 20 parts of TMP (thermomechanical pulp), 5 parts of GP (groundwood pulp) and 5 parts of KP (kraft pulp), mixed pulp with a freeness adjusted to 200 ml was obtained. From the mixed pulp, unsized, non-calendered base paper for newsprint was made using a Bel-Baie former at a paper-making speed of 1100 m/min. This base paper was of 43 $g/m^2$ in basis weight, 0.65 $g/cm^3$ in density, 51% in whiteness, 20 sec. in smoothness, a static friction coefficient of 0.45 and a dynamic friction coefficient of 0.56. Additionally, this base paper did not contain an internal sizing agent and its drop/water absorption degree was 8 sec.

Example of Synthesizing Colloidal Silica 300 ml of sodium silicate solution (No.3 liquid glass $SiO_2$:$Na_2O$=3:2:1, silica concentration 38.1 g -$SiO_2$.L) was poured in a 1L four-neck flask equipped with an agitator, a temperature sensor and a reflux condenser, and the liquid was heated in oil bath at 90° C. while agitating it. While maintaining the liquid at 90° C. in the flask, 138 ml of sulfuric acid of normality 0.72 was dripped into the liquid using a micro tuning pump at a drop speed of 78 ml/min. for 5.5 hours. The liquid that was transparent in the beginning changed to translucent as dripping of sulfuric acid progressed. The composition of this colloidal solution was $SiO_2$:$Na_2SO_4$=64:36, with a solid-content concentration of 5% and a pH value of 10.5.

Embodiment 13

5% colloidal silica solution containing sodium sulfate obtained in the above-mentioned example of synthesizing Colloidal silica was coated on the F surface of the above-mentioned base paper for newsprint as a surface preparation agent using a gate roll coater at a coating speed of 1000 m/min. Super-calendering was performed and newsprint paper was obtained. Regarding this newsprint paper obtained, a coating quantity, peel strength (surface tack), drop/water absorption degree (paper break tendency caused by dampening solution), ink acceptability, opacity and whiteness were measured, and the results are shown in Table 5.

Embodiment 14

Colloidal silica aqueous solution was prepared by diluting 40% aqueous solution of colloidal silica (Product name: Snowtex ST40 produced by Nissan Chemical Ind.) to a solid-content concentration of 5%. As inorganic salt, 5% aqueous solution of sodium sulfate was prepared. A surface preparation agent with a concentration of 5% was prepared by mixing colloidal silica and sodium sulfate in the weight ratio 64 to 36 of sodium sulfate to colloidal silica. The surface preparation agent obtained was coated on the F surface of the base paper for newsprint using a gate roll coater at a coating speed of 1000 m/min, super-calendering was performed, and newsprint paper was obtained. Regarding this newsprint paper obtained, a coating quantity, peel strength (surface tack), drop/water absorption degree (paper break tendency caused by dampening solution), ink acceptability, opacity and whiteness were measured, and the results are shown in Table 5.

Embodiment 15

Newsprint paper was made in the same way as applied to Embodiment 13 except that 5% aqueous solution of sodium sulfate was used as inorganic salt in place of sodium sulfate. Regarding the newsprint paper obtained, a coating quantity, peel strength (surface tack), drop/water absorption degree (paper break tendency caused by dampening solution), ink acceptability, opacity and whiteness were measured, and the results are shown in Table 5.

Embodiment 16

As a surface-sizing agent, 5% aqueous solution of styrene-acrylic acid copolymer (Product name: Colopearl M-305 produced by Seiko Chemical Ind.) was prepared. By mixing the surface-sizing agent prepared and 5% colloidal silica aqueous solution containing sodium sulfate obtained in the example of synthesizing colloidal silica in weight ratio 100 to 25 of the colloidal silica to the surface-sizing agent, a surface preparation agent with a concentration of 5% was prepared. The surface preparation agent obtained was coated on the F surface of the base paper for newsprint using a gate roll coater at a coating speed of 1000 m/min, super-calendering was performed, and newsprint paper was obtained. Regarding this newsprint paper obtained, a coating quantity, peel strength (surface tack), drop/water absorption degree (paper break tendency caused by dampening solution), ink acceptability, opacity and whiteness were measured, and the results are shown in Table 5.

Embodiment 17

Newsprint paper was made in the same way as applied to Embodiment 16 except that alkyd resin (Product name: Size-up 411K produced by Arakawa Chemical Ind.) was used as a surface-sizing agent, in place of styrene-acrylic acid copolymer. Regarding this newsprint paper obtained, a coating quantity, peel strength (surface tack), drop/water absorption degree (paper break tendency caused by dampening solution), ink acceptability, opacity and whiteness were measured, and the results are shown in Table 5.

Embodiment 18

Newsprint paper was made in the same way as applied to Embodiment 16 except that 5% aqueous solution of styrene-maleic acid copolymer (Product name: Colopearl M-300 produced by Seiko Chemical Ind.) was used as a surface-sizing agent, in place of styrene-acrylic acid copolymer. Regarding this newsprint paper obtained, a coating quantity, peel strength (surface tack), drop/water absorption degree (paper break tendency caused by dampening solution), ink acceptability, opacity and whiteness were measured, and the results are shown in Table 5.

Embodiment 19

Newsprint paper was made in the same way as applied to Embodiment 16 except that 5% aqueous solution of olefin-maleic acid copolymer (Product name: Polymalon 482 produced by Arakawa Chemical Ind.) was used as a surface-sizing agent, in place of styrene-acrylic acid copolymer. Regarding this newsprint paper obtained, a coating quantity, peel strength (surface tack), drop/water absorption degree (paper break tendency caused by dampening solution), ink acceptability, opacity and whiteness were measured, and the results are shown in Table 5.

Embodiment 20

Colloidal silica solution was prepared by diluting 40% aqueous solution of colloidal silica (Product name: Snowtex ST-40 produced by Nissan Chemical Ind.) with water to a solid-content concentration of 5%. As inorganic salt, 5% aqueous solution of sodium sulfate was prepared. Colloidal silica/sodium sulfate mixed solution with a concentration of 5% was prepared by mixing colloidal silica and sodium sulfate in the weight ratio 64 to 36. A surface preparation agent with a concentration of 5% was prepared by mixing 5% aqueous solution of styrene-acrylic acid copolymer (Product name: Colopearl M-305 produced by Seiko Chemical Ind.) as a surface-sizing agent in the weight ratio 100 to 25 of colloidal silica to the surface-sizing agent. The surface preparation agent obtained was coated on the F surface of the base paper for newsprint using a gate roll coater at a coating speed of 1000 m/min, super-calendering was performed, and newsprint paper was obtained. Regarding this newsprint paper obtained, a coating quantity, peel strength (surface tack), drop/water absorption degree (paper break tendency caused by dampening solution), ink acceptability, opacity and whiteness were measured, and the results are shown in Table 5.

Embodiment 21

A surface preparation agent with a concentration of 5% was prepared by mixing 5% colloidal silica solution containing sodium sulfate obtained in the example of synthesizing colloidal silica and 5% aqueous solution of oxidized starch (Product name: SK-20 produced by Japan Cornstarch Co.) as an organic binder in the weight ratio 100 to 100 of oxidized starch to colloidal silica. This surface preparation agent obtained was coated on the F surface of the base paper for newsprint using a gate roll coater at a coating speed of 1000 m/min, super-calendering was performed, and newsprint paper was obtained. Regarding this newsprint paper obtained, a coating quantity, peel strength (surface tack), drop/water absorption degree (paper break tendency caused by dampening solution), ink acceptability, opacity and whiteness were measured, and the results are shown in Table 5.

Embodiment 22

Colloidal silica solution was prepared by diluting 40% aqueous solution of colloidal silica (Product name: Snowtex ST40 produced by Nissan Chemical Ind.) with water to a solid-content concentration of 5%. As inorganic salt, 5% aqueous solution of sodium sulfate was prepared. Colloidal silica/sodium sulfate mixed solution with a concentration of 5% was prepared by mixing colloidal silica and sodium sulfate in the weight ratio 64 to 36 of colloidal silica to sodium sulfate. A surface preparation agent with a concentration of 5% was prepared by mixing 5% aqueous solution of oxidized starch (Product name: SK-20 produced by Japan Cornstarch Co.) as an organic binder in the weight ratio 100 to 10 of colloidal silica to oxidized starch. The surface preparation agent obtained was coated on the F surface of the base paper for newsprint using a gate roll coater at a coating speed of 1000 m/min, super-calendering was performed, and newsprint paper was obtained. Regarding this newsprint paper obtained, a coating quantity, peel strength (surface tack), drop/water absorption degree (paper break tendency caused by dampening solution), ink acceptability, opacity and whiteness were measured, and the results are shown in Table 5.

Embodiment 23

A surface preparation agent with a concentration of 5% was prepared by mixing 5% colloidal silica solution containing sodium sulfate obtained in the example of synthesizing colloidal silica and 5% aqueous solution of cationic polyacrylamide (Product name: Harmide RH-125 produced by Harima Chemicals Inc.) as an organic binder in the weight ratio 100 to 100 of cationic polyacrylamide to colloidal silica. This surface preparation agent obtained was coated on the F surface of the base paper for newsprint using a gate roll coater at a coating speed of 1000 m/min, super-calendering was performed, and newsprint paper was obtained. Regarding this newsprint paper obtained, a coating quantity, peel strength (surface tack), drop/water absorption degree (paper break tendency caused by dampening solution), ink acceptability, opacity and whiteness were measured, and the results are shown in Table 5.

Embodiment 24

Colloidal silica solution was prepared by diluting 40% aqueous solution of colloidal silica (Product name: Snowtex ST40 produced by Nissan Chemical Ind.) with water to a solid-content concentration of 5%. As inorganic salt, 5% aqueous solution of sodium sulfate was prepared. Colloidal silica/sodium sulfate mixed solution with a concentration of 5% was prepared by mixing colloidal silica and sodium sulfate in the weight ratio 64 to 36 of colloidal silica to sodium sulfate. A surface preparation agent with a concentration of 5% was prepared by mixing 5% aqueous solution of cationic polyacrylamide (Product name: Harmide RH-125 produced by Harima Chemicals Inc.) as an organic binder in the weight ratio 100 to 40 of colloidal silica to cationic polyacrylamide. The surface preparation agent obtained was coated on the F surface of the base paper for newsprint using a gate roll coater at a coating speed of 1000 m/min, super-calendering was performed, and newsprint paper was obtained. Regarding this newsprint paper obtained, a coating quantity, peel strength (surface tack), drop/water absorption degree (paper break tendency caused by dampening solution), ink acceptability, opacity and whiteness were measured, and the results are shown in Table 5.

Embodiment 25

Colloidal silica solution was prepared by diluting 40% aqueous solution of colloidal silica (Product name: Snowtex ST40 produced by Nissan Chemical Ind.) with water to a solid-content concentration of 5%. As inorganic salt, 5% aqueous solution of sodium sulfate was prepared. Colloidal silica/sodium sulfate mixed solution with a concentration of 5% was prepared by mixing colloidal silica and sodium sulfate in the weight ratio 64 to 36 of colloidal silica to sodium sulfate. A surface preparation agent with a concentration of 5% was prepared by mixing 5% aqueous solution of cationic polyacrylamide (Product name: Harmide RH-125 produced by Harima Chemicals Inc.) as an organic binder in the weight ratio 100 to 40 of colloidal silica to cationic polyacrylamide, and by mixing 5% aqueous solution of styrene-acrylic acid copolymer (Product name: Colopearl M-305 produced by Seiko Chemical Ind.) as a surface-sizing agent in the weight ratio 100 to 25 of colloidal silica to the surface-sizing agent. The surface preparation agent obtained was coated on the F surface of the base paper for newsprint using a gate roll coater at a coating speed of 1000 m/min, super-calendering was performed, and newsprint paper was obtained. Regarding this newsprint paper obtained, a coating quantity, peel strength (surface tack), drop/water absorption degree (paper break tendency caused by dampening solution), ink acceptability, opacity and whiteness were measured, and the results are shown in Table 5.

Embodiment 26

Colloidal silica solution was prepared by diluting 40% aqueous solution of colloidal silica (Product name: Snowtex ST40 produced by Nissan Chemical Ind.) with water to a solid-content concentration of 5%. As inorganic salt, 5% aqueous solution of sodium sulfate was prepared. Colloidal silica/sodium sulfate mixed solution with a concentration of 5% was prepared by mixing colloidal silica and sodium sulfate in the weight ratio 64 to 36 of colloidal silica to sodium sulfate. A surface preparation agent with a concentration of 5% was prepared by mixing 5% aqueous solution of cationic polyacrylamide (Product name: Harmide RH-125 produced by Harima Chemicals Inc.) as an organic binder in the weight ratio 100 to 40 of colloidal silica to cationic polyacrylamide, by mixing 5% aqueous solution of styrene-acrylic acid copolymer (Product name: Colopearl M-305 produced by Seiko Chemical Ind.) as a surface-sizing agent in the weight ratio 100 to 25 of colloidal silica to the surface-sizing agent, and by mixing 5% aqueous solution of titanium oxide (Product name: Taipaque W-10 produced by Ishihara Sangyo) in the weight ratio 100 to 25 of colloidal silica to titanium oxide. The surface preparation agent obtained was coated on the F surface of the base paper for newsprint using a gate roll coater at a coating speed of 1000 m/min, super-calendering was performed, and newsprint paper was obtained. Regarding this newsprint paper obtained, a coating quantity, peel strength (surface tack), drop/water absorption degree (paper break tendency caused by dampening solution), ink acceptability, opacity and whiteness were measured, and the results are shown in Table 5.

Comparative Example 10

Newsprint paper was made in the same way as applied to Embodiment 13 except that a diluent prepared by diluting 40% aqueous solution of colloidal silica (Product name: Snowtex ST40 produced by Nissan Chemical Ind.) with water to a solid-content concentration of 5% was used as a surface preparation agent. Regarding the newsprint paper obtained, a coating quantity, peel strength (surface tack), drop/water absorption degree (paper break tendency caused by dampening solution), ink acceptability, opacity and whiteness were measured, and the results are shown in Table 5.

Comparative Example 11

Newsprint paper was made in the same way as applied to Embodiment 13 except that 5% aqueous solution of sodium sulfate was used as a surface preparation agent. Regarding the newsprint paper obtained, a coating quantity, peel strength (surface tack), drop/water absorption degree (paper break tendency caused by dampening solution), ink acceptability, opacity and whiteness were measured, and the results are shown in Table 5.

Comparative Example 12

Newsprint paper was made in the same way as applied to Embodiment 13 except that 5% aqueous solution of oxidized starch (Product name: SK-20 produced by Japan Cornstarch Co.) was used as a surface preparation agent. Regarding the newsprint paper obtained, a coating quantity, peel strength (surface tack), drop/water absorption degree (paper break tendency caused by dampening solution), ink acceptability, opacity and whiteness were measured, and the results are shown in Table 5.

Comparative Example 13

Newsprint paper was made in the same way as applied to Embodiment 13 except that 5% aqueous solution of anionic polyacrylamide (Product name: Harmicoat N-240 produced by Harima Chemicals Inc.) was used as a surface preparation agent. Regarding the newsprint paper obtained, a coating quantity, peel strength (surface tack), drop/water absorption degree (paper break tendency caused by dampening solution), ink acceptability, opacity and whiteness were measured, and the results are shown in Table 5.

Comparative Example 14

Newsprint paper was made in the same way as applied to Embodiment 13 except that 5% aqueous solution of styrene-acrylic acid copolymer (Product name: Colopearl M-305 produced by Seiko Chemical Ind.) was used as a surface preparation agent. Regarding the newsprint paper obtained, a coating quantity, peel strength (surface tack), drop/water absorption degree (paper break tendency caused by dampening solution), ink acceptability, opacity and whiteness were measured, and the results are shown in Table 5.

Comparative Example 15

5% aqueous solution of oxidized starch (Product name: SK-20 produced by Japan Cornstarch Co.) was prepared. As a surface-sizing agent, 5% aqueous solution of styrene-acrylic acid copolymer (Product name: Colopearl M-305 produced by Seiko Chemical Ind.) was prepared. A surface preparation agent with a concentration of 5% was prepared by mixing them in the weight ratio 100 to 25 of oxidized starch to the surface-sizing agent. Newsprint paper was made in the same way as applied to Embodiment 13 except that the surface preparation agent obtained above was used. Regarding the newsprint paper obtained, a coating quantity, peel strength (surface tack), drop/water absorption degree (paper break tendency caused by dampening solution), ink acceptability, opacity and whiteness were measured, and the results are shown in Table 5.

Comparative Example 16

Newsprint paper was made in the same way as applied to Embodiment 13 except that a 5% aqueous solution of a surface preparation agent with a concentration of 5%, which was prepared by mixing 5% aqueous solution of colloidal silica (Product name: Snowtex ST40 produced by Nissan Chemical Ind.) and 5% aqueous solution of oxidized starch (Product name; SK-20 produced by Japan Cornstarch Co.) in the weight ratio 100 to 100 of colloidal silica to oxidized starch, was used. Regarding the newsprint paper obtained, a coating quantity, peel strength (surface tack), drop/water absorption degree (paper break tendency caused by dampening solution), ink acceptability, opacity and whiteness were measured, and the results are shown in Table 5.

TABLE 5

| | Coating Qty. ($g/m^2$) | Peel Strength (gf/3 cm) | Drop/Water Absorption (sec.) | Ink Acceptability | Opacity (%) | Whiteness (%) | Overall Evaluation |
|---|---|---|---|---|---|---|---|
| Embodiment 13 | 0.31 | 2 | 35 | 0.03 | 88.0 | 60.0 | ○ |
| Embodiment 14 | 0.29 | 2 | 30 | 0.04 | 88.2 | 60.2 | ○ |
| Embodiment 15 | 0.30 | 2 | 32 | 0.03 | 88.1 | 50.0 | ○ |

TABLE 5-continued

| | Coating Qty. ($g/m^2$) | Peel Strength (gf/3 cm) | Drop/Water Absorption (sec.) | Ink Acceptability | Opacity (%) | Whiteness (%) | Overall Evaluation |
|---|---|---|---|---|---|---|---|
| Embodiment 16 | 0.32 | 3 | 170 | 0.02 | 88.1 | 50.1 | ◎ |
| Embodiment 17 | 0.30 | 2 | 160 | 0.03 | 88.7 | 60.1 | ◎ |
| Embodiment 18 | 0.28 | 2 | 160 | 0.02 | 88.1 | 60.2 | ◎ |
| Embodiment 19 | 0.31 | 2 | 155 | 0.03 | 88.3 | 50.1 | ◎ |
| Embodiment 20 | 0.29 | 2 | 160 | 0.03 | 88.2 | 60.3 | ◎ |
| Embodiment 21 | 0.31 | 4 | 34 | 0.03 | 88.5 | 50.1 | ○ |
| Embodiment 22 | 0.31 | 3 | 32 | 0.03 | 88.0 | 50.0 | ○ |
| Embodiment 23 | 0.28 | 3 | 29 | 0.04 | 88.3 | 60.3 | ○ |
| Embodiment 24 | 0.29 | 3 | 30 | 0.03 | 88.2 | 60.2 | ○ |
| Embodiment 25 | 0.32 | 3 | 150 | 0.02 | 88.1 | 50.1 | ◎ |
| Embodiment 26 | 0.30 | 2 | 140 | 0.02 | 90.1 | 52.5 | ◎ |
| Comparative Example 10 | 0.32 | 2 | 9 | 0.06 | 86.5 | 48.2 | Δ |
| Comparative Example 11 | 0.31 | 3 | 7 | — | 87.0 | 48.5 | x |
| Comparative Example 12 | 0.28 | 20 | 8 | 0.10 | 86.9 | 48.2 | x |
| Comparative Example 13 | 0.32 | 70 | 11 | 0.11 | 88.7 | 48.5 | x |
| Comparative Example 14 | 0.31 | 3 | 7 | 0.10 | 97.0 | 48.5 | x |
| Comparative Example 15 | 0.29 | 20 | 8 | 0.10 | 85.9 | 48.2 | x |
| Comparative Example 16 | 0.29 | 8 | 20 | 0.10 | 86.8 | 49.3 | x |

Evaluation of Table 5

As shown in Table 5, the newsprint papers in Embodiments 13 to 15, on which colloidal silica and inorganic salt were coated, had low peel strength, lowered surface tack, high drop/water absorption degrees, improved water absorption resistance, high whiteness and opacity and excellent ink acceptability. The newsprint paper in Comparative Example 10, on which only colloidal silica was coated, had low peel strength, but a low water absorption degree, insufficient water absorption resistance, slightly poor ink acceptability and lowered whiteness and opacity. The newsprint paper in Comparative Example 11, on which only sodium sulfate was coated, had lowered whiteness and opacity, a low drop/water absorption degree. In the ink acceptability test, printing was impossible because sodium sulfate accumulated on the blanket of an offset printing press. The newsprint papers in Embodiments 16 to 20, on which colloidal silica, inorganic salt and surface-sizing agent were coated, had low peel strength, lowered surface tack, very high drop/water absorption degrees, improved water absorption resistance, high whiteness and opacity, and excellent ink acceptability. The newsprint paper in Comparative Example 14, on which only the surface-sizing agent was coated, had low peel strength, poor water absorption resistance and ink acceptability, and lowered whiteness and opacity. The newsprint papers in Embodiments 21 to 24, on which colloidal silica, inorganic salt and organic binder were coated, had low peel strength, lowered surface tack, high drop/water absorption degrees, improved water absorption resistance, high whiteness and opacity, and excellent ink acceptability. The newsprint paper in Embodiment 25, on which colloidal silica, inorganic salt, surface-sizing agent and organic binder were coated, had low peel strength, lowered surface tack, a noticeably high drop/water absorption degree, remarkably improved water absorption resistance, high whiteness and opacity, and excellent ink acceptability. The newsprint paper in Embodiment 26, on which colloidal silica, inorganic salt, surface-sizing agent, organic binder and titanium oxide were coated, had low peel strength, lowered surface tack, a noticeably high drop/water absorption degree, remarkably improved water absorption resistance, extremely high whiteness and opacity, and excellent ink acceptability. The newsprint paper in Comparative Example 12, on which only oxidized starch was coated, and the newsprint paper in Comparative Example 13, on which only anionic polyacrylamide was coated, had high peel strength, decreased surface tack, poor water absorption resistance and ink acceptability, and lowered whiteness and opacity. The newsprint paper in Comparative Example 16, on which colloidal silica and oxidized starch were coated, low peel strength, but poor water absorption resistance and ink acceptability, and lowered whiteness and opacity.

Regarding the dynamic/static friction coefficients of the newsprint papers obtained, for example, the dynamic/static friction coefficients of the newsprint paper in Embodiment 15 were 0.61 and 0.56 respectively. As compared with it, the dynamic/static friction coefficients of the newsprint paper in Comparative Example 4 were 0.50 and 0.51 respectively. The dynamic/static friction coefficients of the newsprint papers on which the surface preparation agent according to the present invention was coated improved. [Dynamic/static friction coefficients were measured pursuant to Japan TAPPI NO.30-79 (The test method for friction coefficients of paper and paperboard)]

INDUSTRIAL APPLICABILITY

With the development of a surface preparation agent containing colloidal silica and inorganic salt in a given ratio, newsprint paper with controlled peel strength (Neppari) and improved ink acceptability, was obtained. By coating the inorganic surface preparation agent according to the present invention using a gate roll coater, it has become possible to obtain newsprint paper having ink acceptability and peel property in a balanced manner. More specifically, in the present invention, newsprint paper having excellent abilities such as low surface tack, low paper powder accumulation on the blanket, adequately maintained water absorption resistance, no paper breaks caused by dampening solution at offset printing, adequate setting property of print ink, no strike through occurrence due to high opacity, and adequate friction coefficients was obtained. Particularly for newsprint paper, newsprint paper suitable for continuous high-speed offset printing can be obtained. Furthermore, tack of a sticky foreign matter caused by a vinyl acetate and hot melt glue, which is used for the back of a magazine and is mixed in DIP, is drastically reduced or is disappeared. Additionally, because the coating agent only comprises inorganic constituents, COD load in waster water when recycled is low. By changing a coating quantity, a compounding ratio, material types of the inorganic surface preparation agent according to the present invention as appropriate, it is easy to accommodate a broad range of product varieties.

What is claimed is:

1. Offset paper for offset printing comprising:

base paper for offset printing; and a coating layer provided on the base paper, said coating layer comprising (i) an inorganic surface preparation agent comprising silica sol or colloidal silica; and (ii) a pigment consisting of an inorganic pigment, said inorganic surface preparation agent comprising an inorganic salt, wherein the inorganic salt is sodium sulfate or sodium nitrate.

2. The offset paper of claim 1, wherein the ratio of the inorganic pigment to the inorganic surface preparation agent is 5 to 50 wt. %.

3. The offset paper of claim 1, wherein the inorganic pigment is selected from the group consisting of titanium oxide, calcium carbonate and white carbon.

4. The offset paper of claim 1, wherein the inorganic surface preparation agent further comprises a surface-sizing agent.

5. The offset paper of claim 4, wherein the ratio of the surface-sizing agent to the colloidal silica or silica sol is 5 to 30 wt. %.

6. The offset paper of claim 5, wherein the surface-sizing agent is selected from the group consisting of styrene-acrylic acid copolymer, alkyd resin, styrene-maleic acid copolymer and olefin-maleic acid copolymers.

7. The offset paper of claim 4, wherein the inorganic surface preparation agent comprises 5 to 40 parts by weight of titanium oxide to 100 parts by weight of the colloidal silica or silica sol.

8. The offset paper of claim 1, wherein the inorganic surface preparation agent comprises an organic binder.

9. The offset paper of claim 8, wherein the organic binder is oxidized starch or cationic polyacrylamide.

10. The offset paper of claim 1, wherein the addition ratio of the inorganic salt is 5 to 250 parts by weight to 100 parts by weight of the colloidal silica or silica sol.

11. The offset paper of claim 1 further comprising an organic binder and a surface-sizing agent.

12. The offset paper of claim 1, wherein the inorganic surface preparation agent comprises an organic binder, a surface-sizing agent and titanium oxide; and wherein the ratio of the titanium oxide is 5 to 40 parts by weight to 100 parts by weight of the solid content of the colloidal silica or silica sol.

13. The offset paper of claim 1, wherein the base paper for offset printing is a newsprint paper having basis weight from about 37 g $m^2$ to about 45 $g/m^2$.

14. Offset paper for offset printing comprising:

base paper for offset printing; and a coating layer provided on the base paper, said coating layer comprising (i) an inorganic surface preparation agent comprising silica sol or colloidal silica; and (ii) a pigment consisting of an inorganic pigment, wherein the inorganic surface preparation agent comprises an inorganic salt, the colloidal silica is a colloidal solution of 10–20 nm using sodium silicate reacted with an inorganic acid, and the inorganic salt is a sodium salt to be a product of the reaction.

15. Offset paper for offset printing comprising:

base paper for offset printing; and a coating layer provided on the base paper, said coating layer comprising (i) an inorganic surface preparation agent comprising silica sol or colloidal silica; and (ii) a pigment consisting of an inorganic pigment, wherein the coating layer is applied in an amount of 0.1–1.0 $g/m^2$ per both sides.

16. Offset paper for offset printing comprising:

base paper for offset printing; and a coating layer provided on the base paper, said coating layer comprising (i) an inorganic surface preparation agent comprising silica sol or colloidal silica; and (ii) a pigment consisting of an inorganic pigment, wherein the coating layer is applied in an amount of 0.3–1.0 $g/m^2$ per both sides.

17. Offset paper for offset printing comprising:

base paper for offset printing; and a coating layer provided on the base paper, said coating layer comprising an inorganic surface preparation agent comprising (i) silica sol or colloidal silica and (ii) an inorganic salt selected from the group consisting of sodium sulfate and sodium nitrate.

18. The offset paper of claim 17, wherein the addition ratio of the inorganic salt is 5 to 250 parts by weight to 100 parts by weight of the colloidal silica or silica sol.

19. The offset paper of claim 17, further comprising an organic binder selected from oxidized starch or cationic polyacrylamide.

20. The offset paper of claim 17, wherein the base paper for offset printing is a newsprint paper having basis weight from about 37 $g/m^2$ to about 45 $g/m^2$.

* * * * *